US006692375B2

(12) United States Patent
Abe

(10) Patent No.: US 6,692,375 B2
(45) Date of Patent: Feb. 17, 2004

(54) GOLF CLUB

(75) Inventor: Nobuo Abe, Tsubame (JP)

(73) Assignee: K.K. Endo Seisakusho, Niigata-ken (JP)

( * ) Notice: Subject to any disclaimer, the term of this patent is extended or adjusted under 35 U.S.C. 154(b) by 0 days.

(21) Appl. No.: 10/039,863

(22) Filed: Oct. 26, 2001

(65) Prior Publication Data

US 2002/0165038 A1 Nov. 7, 2002

(30) Foreign Application Priority Data

Dec. 19, 2000 (JP) ..... 2000-386009

(51) Int. Cl.[7] ..... A63B 53/02
(52) U.S. Cl. ..... 473/310
(58) Field of Search ..... 473/310, 308, 473/309

(56) References Cited

U.S. PATENT DOCUMENTS 5,335,909 A * 8/1994 Green, Jr. ..... 473/305
5,439,218 A * 8/1995 Gondeck ..... 473/308
5,624,330 A * 4/1997 Tsuchida ..... 473/308
5,797,806 A * 8/1998 Butler ..... 473/310
5,855,526 A * 1/1999 Honma ..... 473/310

FOREIGN PATENT DOCUMENTS

JP 10-314345 12/1998

* cited by examiner

*Primary Examiner*—Stephen Blau
(74) *Attorney, Agent, or Firm*—Quarles & Brady LLP

(57) ABSTRACT

A golf club where the center axis of a shaft is precisely aligned to that of a head when connecting the shaft to the head, with improved bonding strength therebetween. A shaft insertion hole 7 is formed on a distal end face 6A of a hosel 6 of a head 2. A shaft 3 is inserted into the hole 7 and is bonded thereto with an adhesive 10. An enlarged portion 8 is formed, which is in the form of a chamfered portion with a peripheral slope formed at an opening portion of the hole 7. The enlarged portion 8 is provided with a ring body 11, while the shaft 3 is inserted into a through-hole 12 formed in the ring body 11. As the shaft 3 is inserted to penetrate through the through-hole 12 of the ring body 11, the shaft 3 is held by the ring body 11 in place within the enlarged portion 8 so that a uniform gap between a distal portion 3A of the shaft 3 and the hole 7 is insured and the thickness of an adhesive can be distributed uniformly. Also, various angles of a golf club such as a lie angle can be formed accurately.

5 Claims, 4 Drawing Sheets

GOLF CLUB

BACKGROUN OF THE INVENTION

1. Field of the Invention

The present invention relates to a golf club.

2. Description of the Related Art

Hitherto when a golf club comprising a head and a shaft is assembled, the shaft is processed rough on the surface of a distal portion thereof, and is fitted with a truncated-cone-shaped, socket-like ferrule, while protruding the shaft itself from the ferrule by a suitable length to be bonded. Thereafter, epoxy-based resin or the like is normally applied to the portion of a shaft to be bonded so that the shaft is fixed to the head. The distal portion of the shaft has a diameter which is about 0.1 mm smaller than an inside diameter of a shaft insertion hole formed in a hosel, in order that an adhesive may be ensured to be present between the hosel and the shaft. Although a gap between the shaft insertion hole in the hosel and the shaft is very narrow, it is very difficult to allow the central axis of the shaft to precisely align with that of the hosel due to this narrow gap, and thus the shaft occasionally is fitted at an offset position and/or inclined toward a certain direction. As a result, such golf club is subjected to changes in angles including loft, lie and face angles after assembling, even though these angles were each in accordance with designed values at the time of the completion of the head. Whilst an adhesive should desirably be applied uniformly to an area for adhesion and then be hardened because one can obtain the highest strength by doing so, there is the possibility, if the gap is not uniform, that the adhesive strength might be reduced and the head get detached from the shaft during the use of the golf club.

For this type of a golf club, Japanese Un-Examined Patent Publication Number 10-314345 discloses a golf club in which a distal end of a shaft is fitted to a hosel in such a manner that the hosel is formed with a stepped peripheral surface, through which the distal end of the shaft is inserted from the outside into the hosel, while a ring made of plastic is bonded to said stepped peripheral surface so that the separation of the shaft from the head may be prevented.

According to the above prior art, the improvement of the joint strength between the head and the shaft is aimed at, using the ring, which, however, has a drawback that it is often very difficult to adjust so as to have the central axis of the shaft precisely align to that of the head, when connecting the shaft to the head, and thus there is a probability that angles including loft, lie and face angles are subjected to delicate changes after the head and the shaft are assembled together.

SUMMARY OF THE INVENTION

Accordingly, it is an object of the present invention to provide a golf club in which the axis of a shaft can be precisely aligned to that of a head when connecting them to each other, to thereby prevent loft, lie, face angles and etc of the club head from deviating from designed values.

It is another object of the present invention to provide a golf club with a high adhesive strength between the head and the shaft.

To attain the above objects, there is provided, according to a first aspect of the present invention, a golf club which comprises: a head having a hosel; a shaft insertion hole provided on a distal end face of said hosel; and a shaft fitted into said shaft insertion hole and bonded thereto with an adhesive, wherein said shaft insertion hole is formed with an enlarged portion formed in an opening portion thereof, while a ring body with a through-hole formed therethrough is provided in said enlarged portion so that said shaft may be inserted and penetrate therethrough.

According to the first aspect, the shaft is inserted into the shaft insertion hole while being guided by the ring body.

According to a second aspect of the present invention, there is provided a golf club as set forth in the first aspect, wherein said enlarged portion is provided in the form of a chamfered portion or a stepped portion so that an outer peripheral face of said ring body is fitted into said enlarged portion.

According to the structure of the second aspect, as the outer peripheral face of the ring body is fitted into and fixed by the chamfered portion or the stepped portion, the shaft can be guided well through said ring body.

According to a third aspect of the present invention, there is provided a golf club according to any of the foregoing aspect, wherein said ring body is made of rubber or plastic.

Accordingly, the ring body is elastically deformable at the time of striking a golf ball.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 1 is a partially cutaway front view showing a golf club according to a first embodiment of the present invention, while

FIG. 3 is a partially cutaway front view showing a golf club according to a second embodiment of the present invention, while

DESCRIPTION OF THE PREFERRED EMBODIMENTS

Hereunder is a description of the embodiments of the present invention with reference to the appended drawings.

Figure 1A:
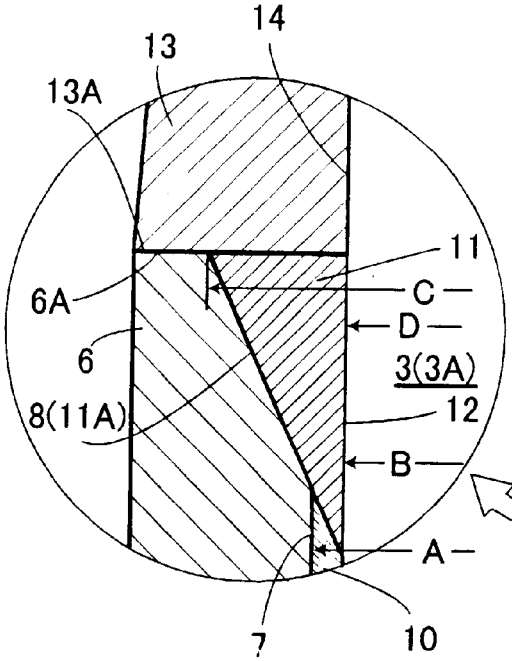
FIG. 1*a* is a partially enlarged section thereof.
Figure 1:
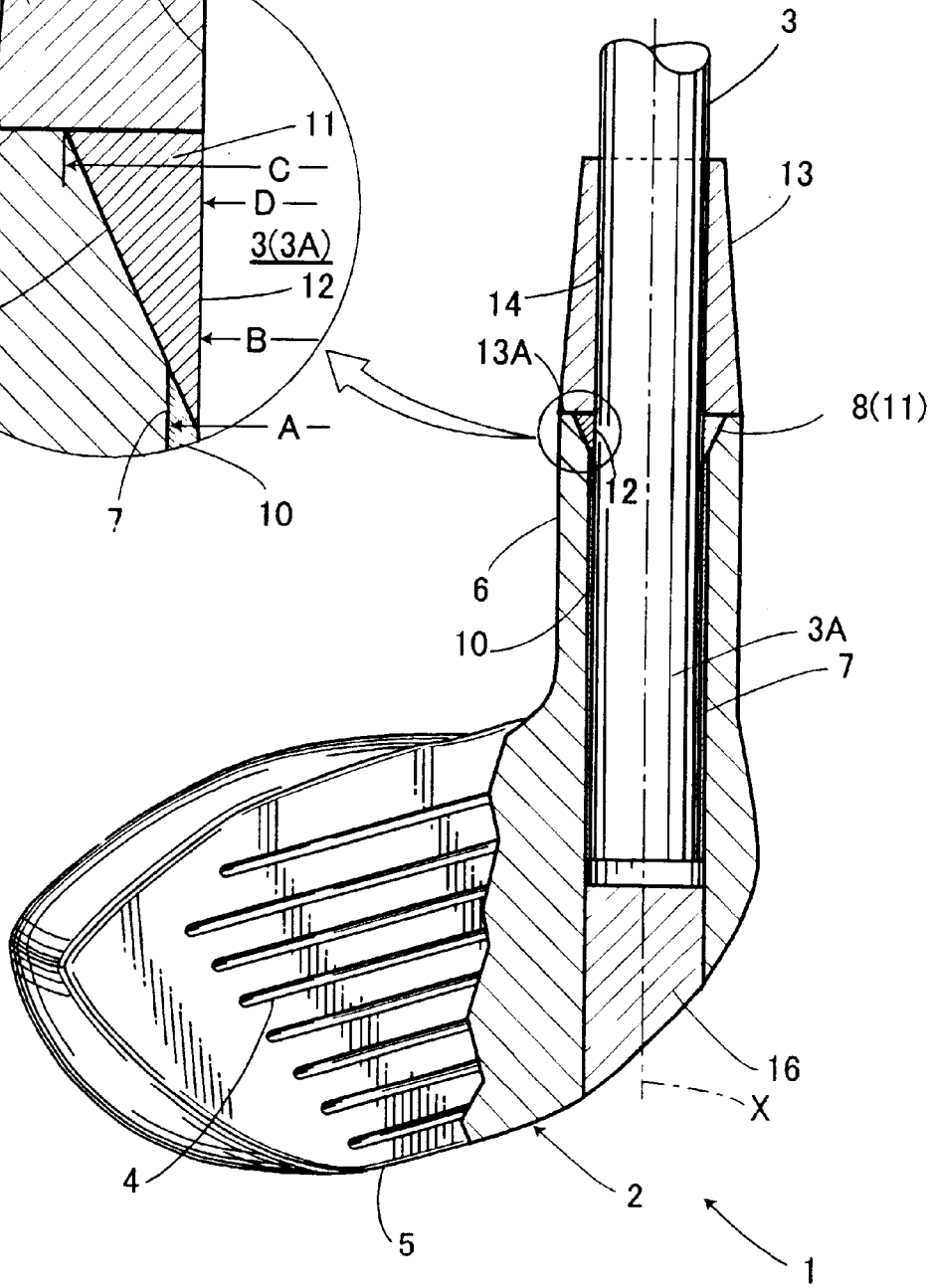
Figure 2:
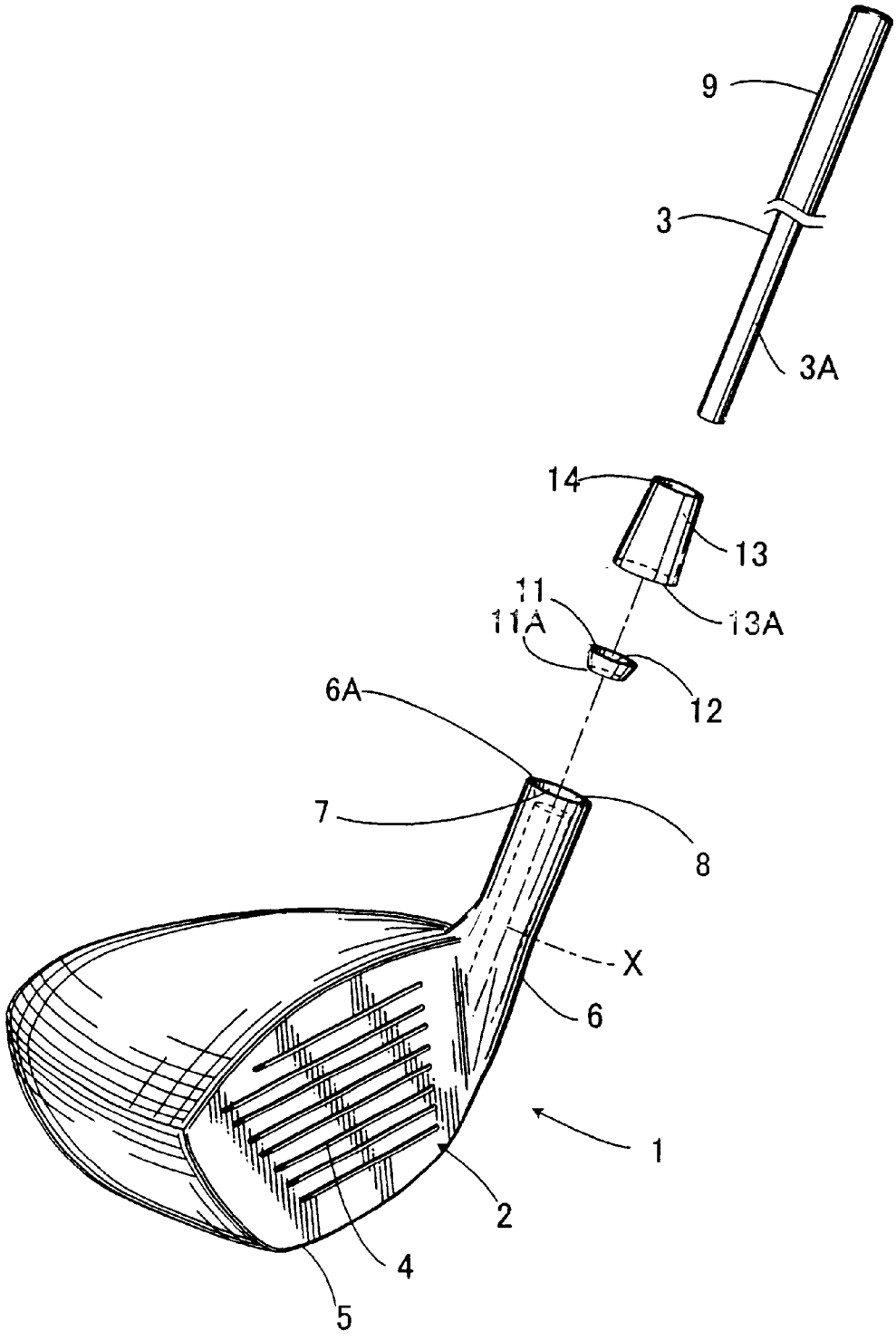
FIG. 2 is an exploded perspective view showing a golf club according to the first embodiment of the present invention.
Figure 3A:
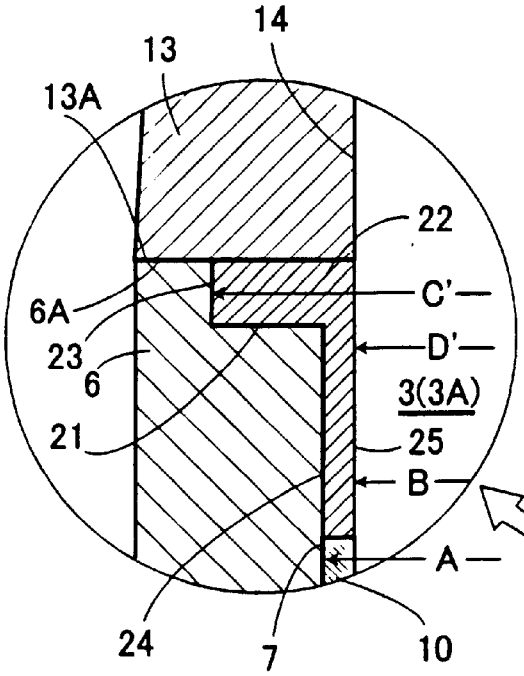
FIG. 3*a* is a partially enlarged section thereof.
Figure 3:
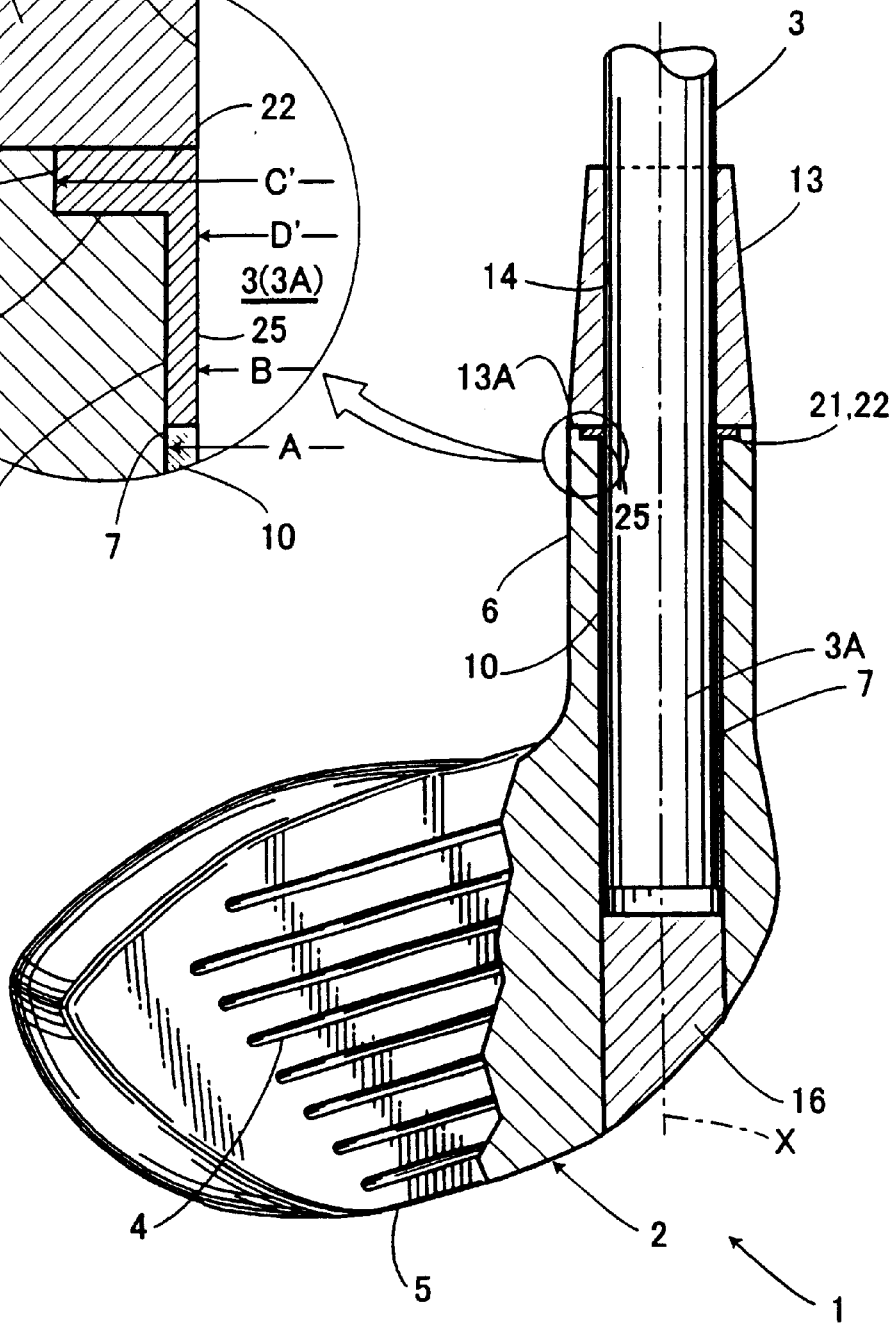
Figure 4:
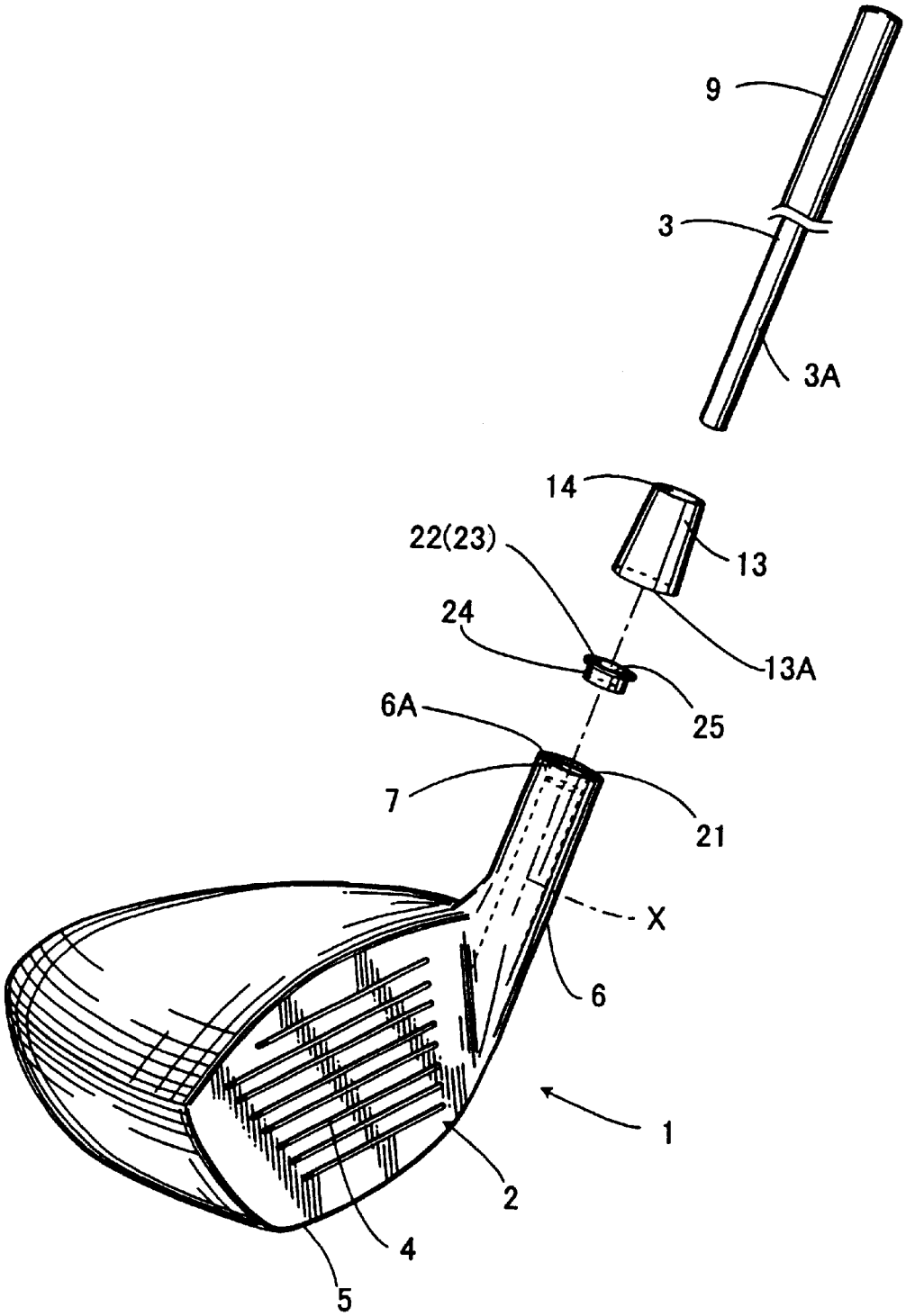
FIG. 4 is an exploded perspective view showing a golf club according to the second embodiment of the present invention.

As shown in FIG. 1 and FIG. 2 showing a first embodiment, a golf club 1 comprises a head 2 and a shaft 3 connected to the head 2, said shaft 3 being formed from metal such as stainless steel or from carbon. The head 2 is provided with a face 4 for striking a ball on a front, a sole 5 on a bottom and a hosel 6 for connecting a shaft 3 thereto on one side, said hosel 6 extending obliquely upward. A shaft insertion hole 7 is defined through a distal end face 6A of the hosel 6 to the sole 5, aligning with the center axis of the hosel 6. The diameter A of the hole 7 that is circular in plane view is formed a little larger than the diameter B of the distal portion 3A of the shaft 3. The opening of the hole 7 is formed with an enlarged portion 8 having a larger diameter C than the diameter A. The enlarged portion 8 is formed into a reverse-tapered shape as a chamfered portion. The shaft 3 with a grip 9 at its proximal end allows the distal portion 3A thereof to be inserted into the hole 7 to be bonded with an adhesive 10.

A ring body 11 which is circular in plane view is provided in the enlarged portion 8 of the hole 7. The ring body 11 is nearly cone-shaped, including a peripheral face 11A formed into a reverse-tapered shape so as to be fitted into the enlarged portion 8; and a through-hole formed through a center thereof for inserting the distal portion 3A therethrough. The ring body 11 is formed from rubber or plastic, preferably fiber reinforced plastic. The strength of the ring body 11 may desirably be set to lower than that of the head 2 and the shaft 3. The diameter D of the through-hole 12 is formed nearly equal to or slightly smaller than the diameter B of the distal portion 3A of shaft 3 so that the distal portion 3A may be fitted into the through-hole 12. Further, a socket-like ferrule 13 is provided on the distal end face 6A of the hosel 6, so as to serve as an auxiliary tube for connection. This ferrule 13 is a truncated-cone-shaped so that a diameter at its bottom 13A may be nearly equal to that of the aforesaid distal end face 6A, including a through-hole 14 formed through the center thereof for fitting the shaft 3 thereinto, while a top portion of the aforesaid ring body 11 fixedly engages with the bottom portion 13A in such a manner that the top portion of the ring body 11 is closed by the bottom portion 13A. In the meantime, reference numeral 16 denotes filler for filling up a gap between the distal portion 3A and the sole 5 in the hole 7.

Next is a description of how a golf club with the aforementioned structure is assembled. The shaft 3 is preliminarily processed rough on the surface of the distal portion 3A, and then fitted into the ferrule 13 with the shaft 3 protruding from the ferrule 13 by a suitable length to be bonded. Further, the distal portion 3A is fitted into the ring body 11. At this moment, the distal portion 3A is fitted into the ring body 11 while the top face of the ring body 11 fixedly engages with the bottom 13A of the ferrule 13, being closely contacted by the same. Then, an adhesive is applied to the hole 7 and the distal portion 3A, which is inserted into the hole 7. At this moment, as the peripheral face 11A of the ring body 11 is fitted to the enlarged portion 8, the center axis of the shaft 3 can be aligned with the center axis X of the hole 7. Under such condition, the adhesive is allowed to be present between the shaft 3 and the hole 7 to thereby bond them each other.

When assembling a golf club of the invention in the foregoing manner, the ring body 11, which is penetrated by the distal portion 3A, is fitted into the enlarged portion 8 formed on the distal end face 6A of the hosel 6, so that the gap between the distal portion 3A of the shaft 3 and the hole 7 can be formed uniformly, due to the ring body 11. Further, as the distal portion 3A is fitted into the through-hole 12 of the ring body 11, the distal portion 3A is guided and held in place so that the center axis of shaft 3 is more easily aligned with the center axis X of the hole 7.

On the other hand, although a strong load is applied to the joint of the shaft 3 and the hosel 6, i.e., a portion of the shaft 3 located at the distal end face 6A of the hosel 6 when a golf player swings the golf club 1 and strikes a golf ball (not shown in the drawings) on the face 4, the impact developed at the portion can be moderated owing to the ring body 11 made of plastic, specifically fiber reinforced plastic, acting as a buffer.

As is apparent from the foregoing, according to the foregoing embodiment, there is provided a golf club which comprises: the head 2 having the hosel 6; the shaft insertion hole 7 provided on the distal end face 6A of the hosel 6; and the shaft 3 fitted into the shaft insertion hole 7 and bonded thereto with an adhesive, wherein said shaft insertion hole 7 is formed with the enlarged portion 8 provided in the form of the chamfered portion defining an inclined peripheral surface in said shaft insertion hole 7, while the ring body 11 with the through-hole 12 formed therethrough is provided in the enlarged portion 8 so that the shaft 3 may be inserted and penetrate therethrough.

Thus, as the ring body 11 is provided in the enlarged portion 8, serving as a countersink or the like preformed in drilling said hole 7 in said head 2, there is no clearance or gap formed in the enlarged portion 8, thus improving the joint strength. Further, as the shaft 3 is held by the ring body 11 in position due to the shaft 3 penetrating the through-hole 12 of the ring body 11, the uniform gap between the distal portion 3A of the shaft 3 and the hole 7 is insured so that the thickness of the adhesive 10 can be uniform, thus enabling the adhesion strength to be distributed uniformly. Also, lie, loft, face angles and the like of a golf club can be formed accurately. Furthermore, as the shaft 3 can be held by the ring body 11, the head 2 and the shaft 3 can be kept stationary until they are bonded by the adhesive 10 at the time of assembly.

Moreover, as said enlarged portion 8 is formed by the chamfered portion and the peripheral face 11A of said ring body 11 is fitted into the enlarged portion 8, the ring body 11 can be firmly fitted into the enlarged portion 8 so that more uniform gap between the shaft 3 and the hole 7 as well as more uniform thickness of the adhesive 10 can be ensured.

Also, as the ring body 11 is made of rubber or plastic, the impact developed at the time of striking a golf ball is absorbed by the ring body 11 due to the elasticity of rubber or plastic, thereby enabling the improving of the anti-impact strength of the shaft 3. Specifically, when the ring body 11 is made of fiber reinforced plastic, the strength thereof can be improved further so that the strength against impact at the joint of the shaft 3 can be improved still further.

Still also, as the upper surface of the ring body 11 is anchored by the ferrule 13 provided on the distal end face 6A of the hosel 6 and penetrated by the shaft 3, the ring body 11 is surrounded by the shaft 3, the enlarged portion 8 and the bottom 13A of the ferrule 13, so that the impact developed at the time of striking can be transferred to the shaft 3 not only via the shaft 3 side but also via the ferrule 13 side when it is transferred to the shaft 3 via the face 4 and the hosel 6, thereby enabling the strength against the impact to be improved.

Moreover, as the distal portion 3A of the shaft 3 penetrates the through-hole 12 of the ring body 11, the ring body 11 can be held together relative to the distal portion 3A. Therefore, when the ring body 11 and the ferrule 13 are integrally attached to the shaft 3, and the distal end portion 3A of the shaft 3 is inserted into the hole 7, the ring body 11 can be automatically fitted into the enlarged portion 8, thus improving assembling efficiency. uniformly. Also, lie, loft, face angles and the like of a golf club can be formed accurately. Furthermore, as the shaft 3 can be held by the ring body 22, the head 2 and the shaft 3 can be kept stationary until they are bonded by the adhesive 10 at the time of assembly.

Specifically, the second embodiment is advantageous in that as the ring body 22 comprises the flange portion 23 fitted into the enlarged portion 21 and the cylindrical portion 24 fitted into the shaft insertion hole 7, said cylindrical portion 24 extending integrally from the flange portion 23, two fitting portions are provided so that the ring body 22 can be accurately fitted into the hole 7 of the hosel 6.

In the meantime, the present invention should not be limited to the above-mentioned embodiments, but various modifications are possible within the scope of the invention.

What is claimed is:

1. A golf club which comprises:

a head having a hosel;

a shaft insertion hole provided on a distal end face of said hosel; and a shaft fitted into said shaft insertion hole and bonded thereto with an adhesive, wherein said shaft insertion hole is formed with an enlarged portion formed in an opening portion thereof, while a ring body with a through-hole formed therethrough is provided in said enlarged portion so that said shaft is insertable and penetratable therethrough, wherein said enlarged portion is provided in the form of a stepped portion, while said ring body comprises: a flange portion to be fitted into said enlarged portion;

a cylindrical portion to be fitted into said shaft insertion hole, said cylindrical portion integrally extending from the flange portion; and wherein said golf club further comprises a ferrule which is provided above the distal end face of said hosel and penetrated by said shaft, and wherein a top surface of said ring body is anchored by the ferrule.

2. A golf club according to claim 1, wherein said ring body is made of rubber or plastic.

3. A golf club according to claim 2, wherein said ring body is made of fiber reinforced plastic.

4. A golf club according to claim 1, wherein said ring body is made of rubber or plastic.

5. A golf club which comprises:

a head having a hosel;

a shaft insertion hole provided on a distal end face of said hosel, said shaft insertion hole being formed with an enlarged portion formed in an opening portion thereof;

a ring body with a through-hole formed therethrough, said ring body being provided in said enlarged portion so that said shaft is insertable and penetratable therethrough; and a shaft fitted into said shaft insertion hole and bonded thereto with an adhesive, wherein said enlarged portion is provided in the form of a chamfered portion so that an outer peripheral face of said ring body is fitted into said enlarged portion, wherein said ring body is nearly cone-shaped, including a peripheral face formed into a reverse-tapered shape so as to be fitted into said enlarged portion; and a through-hole formed through a center of said ring body for inserting a distal portion of said shaft therethrough;

wherein said golf club further comprises a ferrule which is provided above the end face of said hosel and penetrated by said shaft, wherein a top surface of said ring body is anchored by the ferrule in such a manner that the top surface thereof is closed by a bottom of said ferrule, wherein said ring body is made of rubber or plastic, and wherein said ring body is made of fiber reinforced plastic.

* * * * *